US011477873B1

(12) United States Patent
Chen

(10) Patent No.: US 11,477,873 B1
(45) Date of Patent: Oct. 18, 2022

(54) SWITCH CONTROL SYSTEM FOR MOTOR AND LAMP OF FAN

(71) Applicant: AIR COOL INDUSTRIAL CO., LTD., Taichung (TW)

(72) Inventor: Shih-Min Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/523,769

(22) Filed: Nov. 10, 2021

(51) Int. Cl.
*H05B 47/185* (2020.01)
*H05B 47/155* (2020.01)

(52) U.S. Cl.
CPC ..... *H05B 47/185* (2020.01); *H05B 47/155* (2020.01)

(58) Field of Classification Search
CPC .... H05B 47/155; H05B 47/185; H05B 47/19; F21V 33/0096; F21V 23/0435; F04D 25/088; F04D 27/007; F04D 29/005; H02P 6/08
See application file for complete search history.

(56) References Cited

U.S. PATENT DOCUMENTS

| | | | | |
|---|---|---|---|---|
| 7,196,485 | B1 * | 3/2007 | Lee | F24F 7/007 318/400.38 |
| 10,756,662 | B2 * | 8/2020 | Steiner | H02P 1/24 |
| 10,954,948 | B1 * | 3/2021 | Lowe | F04D 25/0606 |
| 11,029,019 | B1 * | 6/2021 | Bucher | H05B 47/19 |

* cited by examiner

*Primary Examiner* — Alexander H Taningco
*Assistant Examiner* — Pedro C Fernandez
(74) *Attorney, Agent, or Firm* — Pai Patent & Trademark Law Firm; Chao-Chang David Pai

(57) ABSTRACT

A switch control system for a motor and a lamp of a fan includes a motor switch, a lamp switch, a detection unit, a wireless remote control receiving unit, a control unit, and a drive unit. The control unit is electrically connected to the motor switch through a motor power processing part. The control unit is electrically connected to the lamp switch through a lamp power processing part. Thus, the motor switch and the wireless remote control receiving unit are able to operate and control the motor independently, and the lamp switch and the wireless remote control receiving unit are able to operate and control the lamp independently.

9 Claims, 2 Drawing Sheets

SWITCH CONTROL SYSTEM FOR MOTOR AND LAMP OF FAN

FIELD OF THE INVENTION

The present invention relates to a fan, and more particularly to a switch control system for a motor and a lamp of a fan.

BACKGROUND OF THE INVENTION

A conventional ceiling fan includes a lamp and a motor. Both the lamp and the motor are controlled by a micro-processing chip. The micro-processing chip is electrically connected to a power processing unit and a wireless receiver, respectively. The wireless receiver is controlled by a wireless signal from a wireless remote controller. The power processing unit is electrically connected to a mains power supply (AC power supply) through a switch. Due to chip production capacity and cost factors, ceiling fans are often controlled by a single micro-processing chip. The switch, the wireless remote controller and the power processing unit can only control the lamp and the motor at the same time. The lamp and the motor cannot be controlled independently according to different requirements of use, which causes great inconvenience in use. Accordingly, the inventor of the present invention has devoted himself based on his many years of practical experiences to solve these problems.

SUMMARY OF THE INVENTION

The primary object of the present invention is to provide a switch control system for a motor and a lamp of a fan, which can independently operate and control the lamp and the motor to improve the fan and increase the degree of freedom of the switch control of the lamp.

In order to achieve the above object, the present invention provides a switch control system mounted to a fan. The fan has a motor and a lamp. The switch control system comprises a switch unit, a power processing unit, a detection unit, a wireless remote control receiving unit, a control unit, and a drive unit. The switch unit has a motor switch and a lamp switch. The motor switch and the lamp switch are electrically connected to a mains power supply. The motor switch has an on state and an off state. The motor switch outputs a motor switch signal in the on state. The lamp switch has an on state and an off state. The lamp switch outputs a lamp switch signal in the on state. The power processing unit has a motor power processing part and a lamp power processing part. The motor power processing part is electrically connected to the motor switch for receiving the motor switch signal. The motor power processing part is configured to process the motor switch signal to output a motor power processing signal. The lamp power processing part is electrically connected to the lamp switch for receiving the lamp switch signal. The lamp power processing part is configured to process the lamp switch signal to output a lamp power processing signal. The detection unit has a motor switch detection part and a lamp switch detection part. The motor switch detection part is electrically connected to the motor switch to receive the motor switch signal and detect the on/off state of the motor switch for the motor switch detection part to output a motor switch detection signal. The lamp switch detection part is electrically connected to the lamp switch to receive the lamp switch signal and detect the on/off state of the lamp switch for the lamp detection part to output a lamp switch detection signal.

The wireless remote control receiving unit is in signal communication with a wireless remote controller. The wireless remote controller is configured to output a wireless signal to the wireless remote control receiving unit for the wireless remote control receiving unit to output a motor remote control signal and a lamp remote control signal. The control unit is electrically connected to the motor power processing part, the lamp power processing part, the motor switch detection part, the lamp switch detection part, and the wireless remote control receiving unit. The control unit is configured to activate the control unit and keep the control unit in an activated state according to at least one of the motor power processing signal and the lamp power processing signal. When the control unit is in the activated state, the control unit outputs a motor control signal according to at least one of the motor switch detection signal and the motor remote control signal. The control unit outputs a lamp control signal according to at least one of the lamp switch detection signal and the lamp remote control signal. The drive unit has a motor drive part and a lamp drive part. The motor drive part is electrically connected to the motor switch. The motor drive part controls the motor according to the motor control signal. The lamp drive part is electrically connected to the lamp switch, the control unit and the lamp. The lamp drive part controls the lamp according to the lamp control signal.

In the switch control system provided by the present invention, through the structure of the motor power processing part and the lamp power processing part, the motor switch and the wireless remote control receiving unit are able to operate and control the motor independently, and the lamp switch and the wireless remote control receiving unit are able to operate and control the lamp independently.

DETAILED DESCRIPTION OF THE PREFERRED EMBODIMENTS

Embodiments of the present invention will now be described, by way of example only, with reference to the accompanying drawings.

Figure 1:
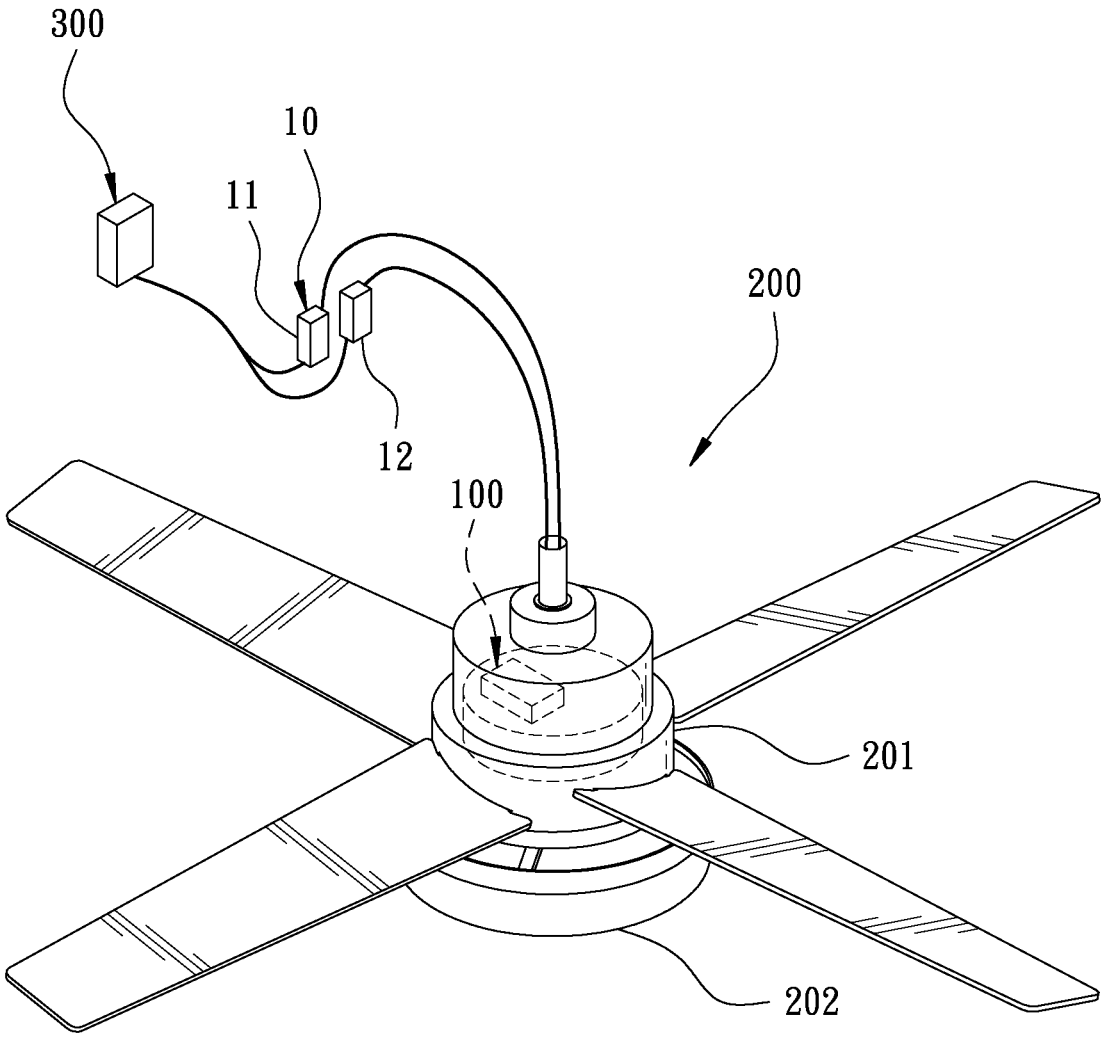
FIG. 1 is a schematic view of a preferred embodiment of the present invention when in use.
Figure 2:
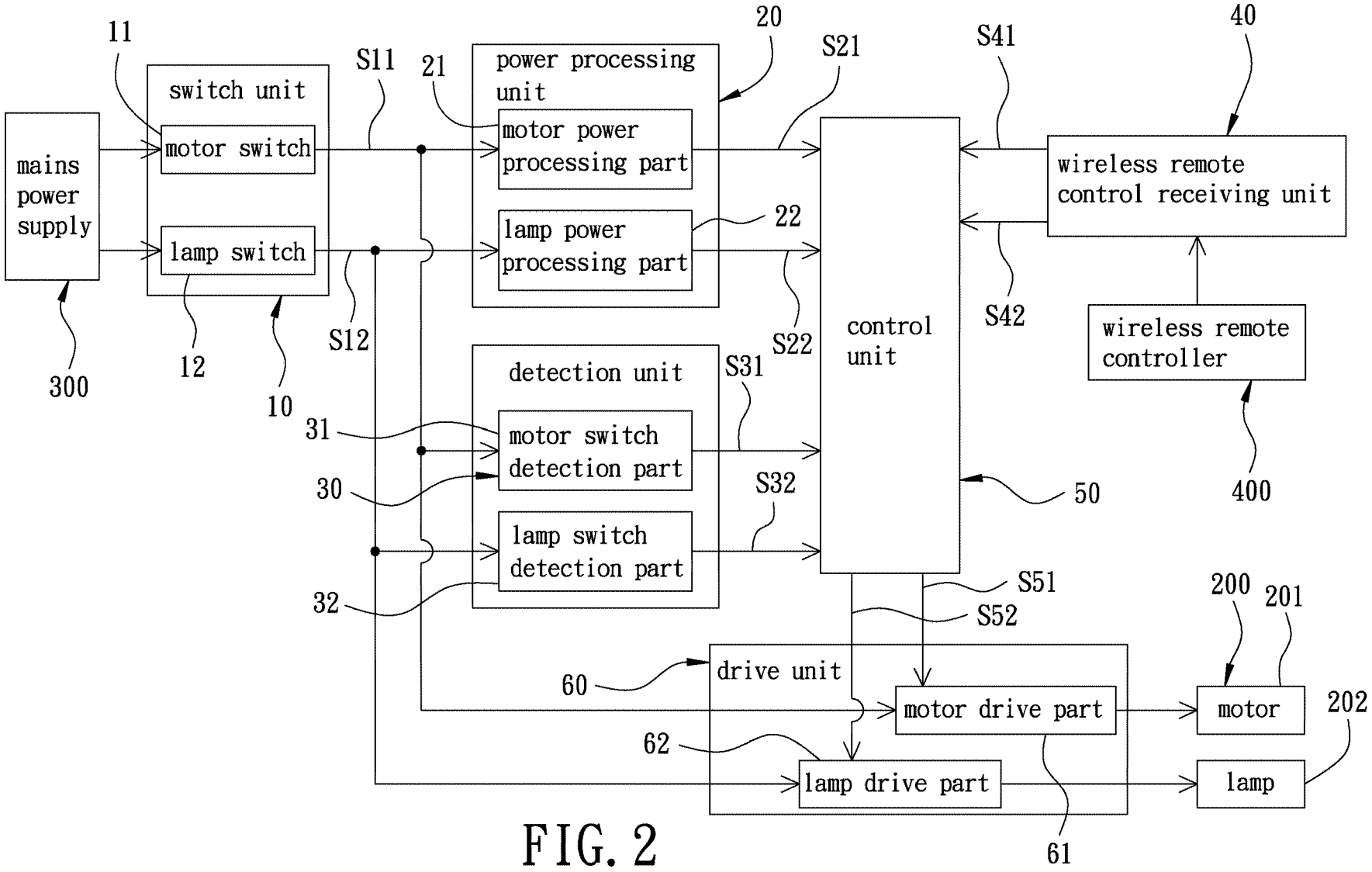
FIG. 2 is a block diagram of the preferred embodiment of the present invention.

As shown in FIG. 1 and FIG. 2, the present invention discloses a switch control system 100 for a motor and a lamp of a fan, which is mounted to a fan 200. The fan 200 has a motor 201 and a lamp 202. The switch control system 100 comprises a switch unit 10, a power processing unit 20, a detection unit 30, a wireless remote control receiving unit 40, a control unit 50, and a drive unit 60.

The switch unit 10 has a motor switch 11 and a lamp switch 12. The motor switch 11 and the lamp switch 12 are electrically connected to a mains power supply 300. The motor switch 11 has an on state and an off state. The motor switch 11 outputs a motor switch signal S11 in the on state. The lamp switch 12 has an on state and an off state. The lamp switch 12 outputs a lamp switch signal S12 in the on state.

The power processing unit 20 has a motor power processing part 21 and a lamp power processing part 22. The motor power processing part 21 is electrically connected to the motor switch 11 for receiving the motor switch signal S11. The motor power processing part 21 is configured to process the motor switch signal S11 to output a motor power processing signal S21. The motor power processing part 21 performs analog-to-digital conversion of the motor switch signal S11 to output the motor power processing signal S21. The lamp power processing part 22 is electrically connected to the lamp switch 12 for receiving the lamp switch signal S12. The lamp power processing part 22 is configured to process the lamp switch signal S12 to output a lamp power processing signal S22. The lamp power processing part 22 performs analog-to-digital conversion of the lamp switch signal S12 to output the lamp power processing signal S22.

The detection unit 30 has a motor switch detection part 31 and a lamp switch detection part 32. The motor switch detection part 31 is electrically connected to the motor switch 11 to receive the motor switch signal S11 and detect the on/off state of the motor switch 11 for the motor switch detection part 31 to output a motor switch detection signal S31. The lamp switch detection part 32 is electrically connected to the lamp switch 12 to receive the lamp switch signal S12 and detect the on/off state of the lamp switch 12 for the lamp detection part 32 to output a lamp switch detection signal S32.

The wireless remote control receiving unit 40 is in signal communication with a wireless remote controller 400. The wireless remote controller 400 is configured to output a wireless signal to the wireless remote control receiving unit 40 for the wireless remote control receiving unit 40 to output a motor remote control signal S41 and a lamp remote control signal S42.

The control unit 50 is electrically connected to the motor power processing part 21, the lamp power processing part 22, the motor switch detection part 31, the lamp switch detection part 32, and the wireless remote control receiving unit 40. The control unit 50 is configured to activate the control unit 50 and keep the control unit 50 in an activated state according to at least one of the motor power processing signal S21 and the lamp power processing signal S22. When the control unit 50 is in the activated state, the control unit 50 outputs a motor control signal S51 according to at least one of the motor switch detection signal S31 and the motor remote control signal S41. The control unit 50 outputs a lamp control signal S52 according to at least one of the lamp switch detection signal S32 and the lamp remote control signal S42. The lamp control signal S52 may include at least one of on/off control, brightness control, and color temperature control.

The drive unit 60 has a motor drive part 61 and a lamp drive part 62. The motor drive part 61 is electrically connected to the motor switch 11, the control unit 50 and the motor 201. The motor drive part 61 is electrically connected to the motor switch 11, the motor power processing part 21, the motor switch detection part 31, the control unit 50, and the motor 201. The motor drive part 61 controls the motor 201 according to the motor control signal S51. The lamp drive part 62 is electrically connected to the lamp switch 12, the control unit 50, and the lamp 202. The lamp drive part 62 is electrically connected to the lamp switch 12, the lamp power processing part 22, the lamp switch detection part 32, the control unit 50, and the lamp 202. The lamp drive part 62 controls the lamp 202 according to the lamp control signal S52.

FIG. 2 is a block diagram of the preferred embodiment of the present invention. When the motor switch 11 is in the on state, the motor power processing part 21, the motor switch detection part 31 and the motor drive part 61 receive the motor switch signal S11 of the motor switch 11, and the control unit 50 activates the control unit 50 and keeps the control unit 50 in the activated state according to at least one of the motor power processing signal S21 and the lamp power processing signal S22. The control unit 50 outputs the motor control signal S51 to the motor drive part 61 and controls the motor 201 according to at least one of the motor switch detection signal S31 or the motor remote control signal S41, so that the motor switch 11 has the effect of operating and controlling the motor 201 independently.

When the lamp switch 12 is in the on state, the lamp power processing part 22, the lamp switch detection part 32 and the lamp drive part 62 receive the lamp switch signal S12 of the lamp switch 12, and the control unit 50 activates the control unit 50 and keeps the control unit 50 in the activated state according to at least one of the motor power processing signal S21 and the lamp power processing signal S22. The control unit 50 outputs the lamp control signal S52 to the lamp drive part 62 and controls the lamp 202 according to at least one of the lamp switch detection signal S32 and the lamp remote control signal S42, so that the lamp switch 12 has the effect of operating and controlling the lamp 202 independently.

When both the motor switch 11 and the lamp switch 12 are in the on state and when the motor 201 and the lamp 202 are in the on state, the control unit 50 receives the motor remote control signal S41 to output the motor control signal S51 to the motor drive part 61 for controlling the motor 201 to be in the off state, without affecting the on state of the lamp 202. The wireless remote control receiving unit 40 has the effect of independently operating and controlling the motor 201. In addition, by turning off and then turning on the motor switch 11, the control unit 50 receives the motor switch detection signal S31 again to output the motor control signal S51 to the motor drive part 61 for controlling the motor 201 to be in the on state.

When both the motor switch 11 and the lamp switch 12 are in the on state and when the motor 201 and the lamp 202 are in the on state, the control unit 50 receives the lamp remote control signal S42 to output the lamp control signal S52 to the lamp drive part 62 for controlling the lamp 202 to be in the off state, without affecting the on state of the motor 201. The wireless remote control receiving unit 40 has the effect of independently operating and controlling the lamp 202. In addition, by turning off and then turning on the motor switch 12, the control unit 50 receives the lamp switch detection signal S32 again to output the lamp control signal S52 to the lamp drive part 62 for controlling the lamp 202 to be in the on state.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A switch control system, mounted to a fan, the fan having a motor and a lamp, the switch control system comprising:

a switch unit, having a motor switch and a lamp switch, the motor switch and the lamp switch being electrically connected to a mains power supply, the motor switch having an on state and an off state, the motor switch outputting a motor switch signal in the on state, the lamp switch having an on state and an off state, the lamp switch outputting a lamp switch signal in the on state;

a power processing unit, having a motor power processing part and a lamp power processing part, the motor power processing part being electrically connected to the motor switch for receiving the motor switch signal, the motor power processing part being configured to process the motor switch signal to output a motor power processing signal, the lamp power processing part being electrically connected to the lamp switch for receiving the lamp switch signal, the lamp power processing part being configured to process the lamp switch signal to output a lamp power processing signal;

a detection unit, having a motor switch detection part and a lamp switch detection part, the motor switch detection part being electrically connected to the motor switch to receive the motor switch signal and detect the on/off state of the motor switch for the motor switch detection part to output a motor switch detection signal, the lamp switch detection part being electrically connected to the lamp switch to receive the lamp switch signal and detect the on/off state of the lamp switch for the lamp detection part to output a lamp switch detection signal;

a wireless remote control receiving unit, being in signal communication with a wireless remote controller, the wireless remote controller being configured to output a wireless signal to the wireless remote control receiving unit for the wireless remote control receiving unit to output a motor remote control signal and a lamp remote control signal;

a control unit, electrically connected to the motor power processing part, the lamp power processing part, the motor switch detection part, the lamp switch detection part and the wireless remote control receiving unit, the control unit being configured to activate the control unit and keep the control unit in an activated state according to at least one of the motor power processing signal and the lamp power processing signal, wherein when the control unit is in the activated state, the control unit outputs a motor control signal according to at least one of the motor switch detection signal and the motor remote control signal, the control unit outputs a lamp control signal according to at least one of the lamp switch detection signal and the lamp remote control signal;

a drive unit, having a motor drive part and a lamp drive part, the motor drive part being electrically connected to the motor switch, the control unit and the motor, the motor drive part controlling the motor according to the motor control signal, the lamp drive part being electrically connected to the lamp switch, the control unit and the lamp, the lamp drive part controlling the lamp according to the lamp control signal.

2. The switch control system as claimed in claim 1, wherein when both the motor switch and the lamp switch are in the on state and when the motor and the lamp are in the on state, the control unit receives the motor remote control signal to output the motor control signal to the motor drive part for controlling the motor to be in the off state, without affecting the on state of the lamp, by turning off and then turning on the motor switch, the control unit receives the motor switch detection signal to output the motor control signal to the motor drive part for controlling the motor to be in the on state.

3. The switch control system as claimed in claim 2, wherein when both the motor switch and the lamp switch are in the on state and when the motor and the lamp are in the on state, the control unit receives the lamp remote control signal to output the lamp control signal to the lamp drive part for controlling the lamp to be in the off state, without affecting the on state of the motor, by turning off and then turning on the motor switch, the control unit receives the lamp switch detection signal to output the lamp control signal to the lamp drive part for controlling the lamp to be in the on state.

4. The switch control system as claimed in claim 3, wherein the motor power processing part performs analog-to-digital conversion of the motor switch signal to output the motor power processing signal, and the lamp power processing part performs analog-to-digital conversion of the lamp switch signal to output the lamp power processing signal.

5. The switch control system as claimed in claim 4, wherein the motor drive part is electrically connected to the motor switch, the motor power processing part, the motor switch detection part, the control unit and the motor, and the lamp drive part is electrically connected to the lamp switch, the lamp power processing part, the lamp switch detection part, the control unit, and the lamp.

6. The switch control system as claimed in claim 5, wherein the lamp control signal includes at least one of on/off control, brightness control and color temperature control.

7. The switch control system as claimed in claim 1, wherein the motor power processing part performs analog-to-digital conversion of the motor switch signal to output the motor power processing signal, and the lamp power processing part performs analog-to-digital conversion of the lamp switch signal to output the lamp power processing signal.

8. The switch control system as claimed in claim 1, wherein the motor drive part is electrically connected to the motor switch, the motor power processing part, the motor switch detection part, the control unit and the motor, and the lamp drive part is electrically connected to the lamp switch, the lamp power processing part, the lamp switch detection part, the control unit, and the lamp.

9. The switch control system as claimed in claim 1, wherein the lamp control signal includes at least one of on/off control, brightness control and color temperature control.

* * * * *